US006702166B1

(12) United States Patent
Niemivuo et al.

(10) Patent No.: US 6,702,166 B1
(45) Date of Patent: Mar. 9, 2004

(54) AUXILIARY DEVICE FOR SERVING

(76) Inventors: Tanja Niemivuo, Ylistörmä 5 E 80, FIN-02210 Espoo (FI); Juhamatti Niemivuo, Ylistörmä 5 E 80, FIN-02210 Espoo (FI)

( * ) Notice: Subject to any disclaimer, the term of this patent is extended or adjusted under 35 U.S.C. 154(b) by 0 days.

(21) Appl. No.: 09/980,399

(22) PCT Filed: Mar. 31, 2000

(86) PCT No.: PCT/FI00/00281

§ 371 (c)(1),
(2), (4) Date: Dec. 3, 2001

(87) PCT Pub. No.: WO00/74543

PCT Pub. Date: Dec. 14, 2000

(30) Foreign Application Priority Data

Jun. 2, 1999 (FI) ..... 991256

(51) Int. Cl.[7] ..... A45F 5/00

(52) U.S. Cl. ..... 224/219; 224/222; 108/43; 294/144

(58) Field of Search ..... 224/219, 222; D7/552.2, 552.1; 108/43; 24/3.2; 294/144, 172; 248/689; 206/557

(56) References Cited

U.S. PATENT DOCUMENTS 1,281,025 A * 10/1918 Klein ..... 24/3.2
1,594,215 A * 7/1926 Sides ..... 206/371
1,827,607 A * 10/1931 Pfaffinger ..... 24/3.2
2,605,032 A * 7/1952 Hunt et al. ..... 223/109 R
2,647,716 A * 8/1953 Hudziak et al. ..... 108/43
2,686,701 A * 8/1954 Manczur ..... 108/157.11
2,770,514 A * 11/1956 Idso ..... 108/43
2,777,626 A * 1/1957 French ..... 206/557
2,787,507 A * 4/1957 Powers ..... 108/43
3,185,113 A * 5/1965 Nathan et al. ..... 108/43
3,504,832 A * 4/1970 Corvetti ..... 294/144
3,941,286 A 3/1976 Perkinson ..... 224/48
4,737,390 A * 4/1988 Fricano et al. ..... 206/557
5,067,761 A * 11/1991 Blowers ..... 294/3.5
5,140,723 A * 8/1992 Genzel ..... 24/3.2
5,176,274 A * 1/1993 Jenkins ..... 108/43
5,255,612 A * 10/1993 Anderson ..... 108/43
D351,738 S * 10/1994 LaCombe ..... D6/336
5,634,568 A 6/1997 Wawrzyniak ..... 220/570
5,769,264 A 6/1998 Lipkowitz ..... 220/575
D395,983 S * 7/1998 Panta Chica ..... D7/552.2
5,810,220 A * 9/1998 Petersen ..... 224/222
D409,400 S * 5/1999 Peruzzo ..... D6/328
6,029,938 A * 2/2000 Fava ..... 108/43
6,240,565 B1 * 6/2001 Spear ..... 2/158
D453,265 S * 2/2002 Way ..... D3/215

* cited by examiner

*Primary Examiner*—Nathan J. Newhouse
(74) *Attorney, Agent, or Firm*—Connolly Bove Lodge & Hutz LLP

(57) ABSTRACT

An auxiliary device for serving ready portions of food to a table, or for serving food from a dish, is provided. The auxiliary device includes a holder for fixing the auxiliary device on an arm of a waiter and a support member for a plate or a dish carried by the holder. The auxiliary device enables the waiter to conveniently carry 4 to 7 portions at a time to a table, as well as to protect his arm from a hot dish when serving from a dish.

7 Claims, 2 Drawing Sheets

AUXILIARY DEVICE FOR SERVING

This invention concerns a waiter's auxiliary device for carrying ready portions of food to a table or for serving food from a dish.

Previously, on serving ready portions to a table, not more than three or possibly five plates could be carried at a time, depending on the skill of the waiter and the size of the portions. When serving three plates at a time, a first plate is supported by the three central fingers of one hand, a second plate is supported by the thumb, little finger and palm of the same hand and a third plate is carried in the other hand. On serving food from a dish to a plate of a customer the waiter's arm will for a long time be in contact with the hot dish that he carries, simultaneously as the dish has to be kept in balance on the hand and arm.

The object of the present invention is to facilitate and increase the efficiency of the work of a waiter and to eliminate the above-mentioned problems. This is achieved by means of an auxiliary device, which is characterized in that the auxiliary device comprises a holder to be clamped onto an arm of a waiter, and carried by the holder a transversally extending support plate for supporting a plate or a dish partly placed on palm of the waiter. The auxiliary device is intended to be placed on the arm so that the support plate of the same is in a horizontal position when the arm is in a carrying position. According to a preferred embodiment the holder of the auxiliary device comprises two cooperating, somewhat elastic clamping legs extending forklike or U-shaped from underside of the support plate. The stiffness and shape of the clamping legs should be chosen so that the auxiliary device stays firmly on the arm of the waiter. The holder preferably has a short bar connecting the clamping legs to the center of the support plate, which bar forms a skew angle with the support plate. By means of the auxiliary device according to the invention a waiter is able to carry 4 to 8 plates of portions at a time to a table. An additional plate can be placed supported by the support plate of the auxiliary device, which is clamped on the arm and the wrist, and another additional plate can be fitted from a direction of the other hand into a gap between the support plate and a clamping leg, in which gap there is an acute angle between the support plate and the bar. When serving from a dish the auxiliary device according to the invention will also help in holding the dish firmly in place and will simultaneously protect the arm of the waiter from excessive heat.

Further features of the invention will appear from the dependent claims.

Figure 1:
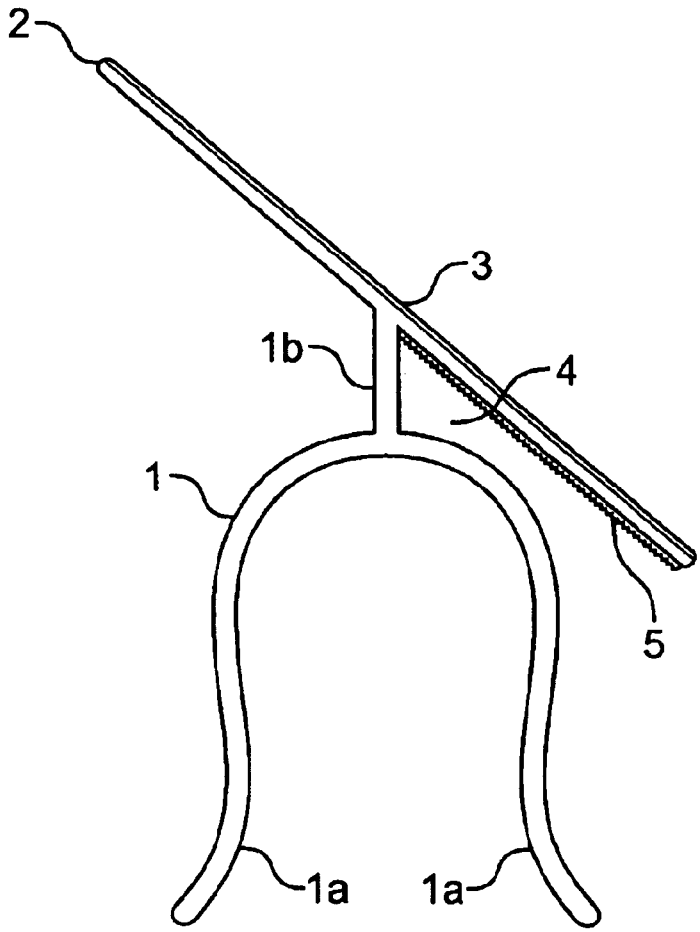
Figure 2:
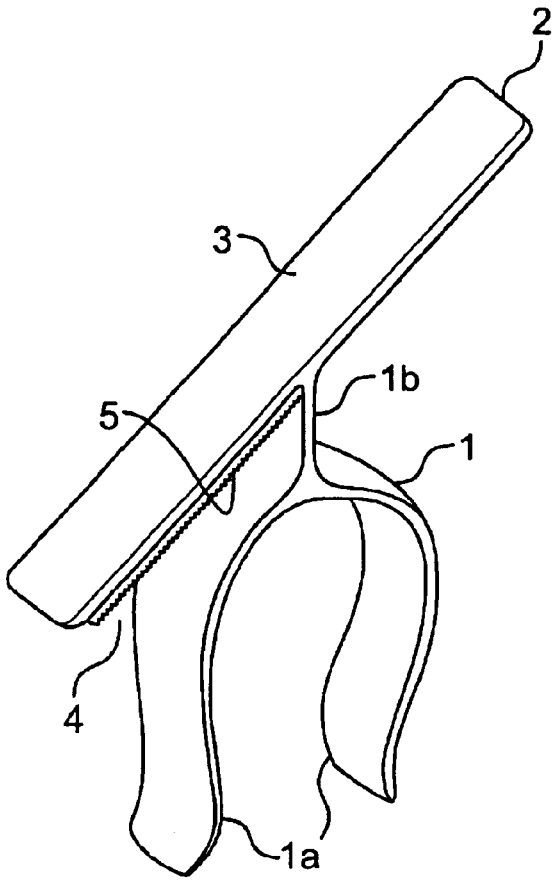

Below the invention will be disclosed in more detail with reference to the enclosed drawing, wherein FIG. 1 shows a side view of an example of an auxiliary device according to the invention and FIG. 2 shows, in perspective, an auxiliary device according to the invention.

The device according to the invention comprises a holder 1, by means of which the auxiliary device can be fixed on the arm of a waiter, as well as a support plate 2 for a plate or a dish, which support plate 2 is carried by the holder 1. The auxiliary device is positioned on the arm so that the support plate 2 will be in a horizontal position when the arm is kept in a carrying position. The bottom portion of a plate or dish placed on the auxiliary device is carried by the support plate 2, simultaneously as a front portion of the bottom of the plate or dish is in contact with the waiter's wrist or palm. The wrist is then preferably protected by a towel or napkin.

In a preferred embodiment of the invention, the holder 1 of the auxiliary device comprises two cooperating elastic clamping legs la extending forklike or U-shaped from the underside of the support plate 2, so that the clamping legs 1*a*, when the auxiliary device is fixed on the arm, will clamp an upper and an under side of the arm, keeping the auxiliary device firmly in position.

The support plate 2 is preferably a flat, oblong piece, the longitudinal central axis of which is positioned in a vertical middle plane of the auxiliary device. Due to this, the support plate 2 extends transversally over the arm when the auxiliary device is fixed on said arm. When directed in this way the support plate 2 gives the plate the best possible support.

In order to get the plate in a correct horizontal position when the arm is in a carrying position, it is preferred that the holder 1 of the auxiliary device comprises a short bar 1*b*, connecting the clamping legs 1*a* to midpoint of the support plate 2. The bar 1*b* then forms advantageously a skew angle with the support plate 2, as shown in the drawings, which guarantees the above mentioned horizontal position of the support plate 2 when the arm is in a carrying position. A gap 4 between the support plate 2 and a clamping leg 1*a*, in which gap 4 the bar 1*b* forms an acute angle with the support plate 2, can thus conveniently be used as a carrying and supporting means for yet another plate, by pushing the edge of the plate into said gap 4. The auxiliary device should be fixed on the arm in such a way that said gap 4 in a carrying position is directed towards the other hand. In order for a plate to be securely positioned in gap 4, a friction means 5, for instance a rubber pad with transverse folds or grooves or something similar, can preferably be fixed to the underside of the support plate 2.

The auxiliary device can preferably be manufactured completely of metal or thermoresistant plastics. According to one embodiment the clamping legs 1*a* are manufactured of spring steel in order to provide as good an elasticity and a strength as possible. The auxiliary device can also be manufactured completely of plastics, for instance, fibre-reinforced plastics, which guarantees the structure a sufficient strength and the clamping legs la a suitable rigidity/elasticity.

The outer surface of the auxiliary device may, for instance, be provided with a shiny metal surface, such as a brass or steel surface. Its outer surface may also be gold-plated, silver-plated or painted. According to another alternative, the auxiliary device is provided with a replaceable textile coating. A textile coating matching the dress of the wearer can then be put upon the auxiliary device, making it less conspicuous.

In order to assure that a plate or a dish will stay on the support plate 2 of the auxiliary device, a friction increasing means 3, such as a rubber pad or a polyuretane film, can preferably be fixed to the upper surface of support plate 2.

By means of an auxiliary device according to the invention, a waiter may bring up to seven portions at a time, whereby three plates are supported by the fingers of one hand, one plate is supported by the support plate 2 of the auxiliary device and the palm, and the edge of another plate is fitted into the gap 4 between the support plate 2 and one of the clamping legs 1*a* of the auxiliary device. Two plates can be carried supported by the fingers of the other hand, making a total of seven plates of portions.

What is claimed is:

1. Waiter's auxiliary device for carrying ready portions of food to a table or for serving food from a dish, said auxiliary device comprising a holder adapted to be clamped onto an arm of a waiter, and a flat oblong support plate carried by said holder, said holder comprising a fork or U-shaped clamp made of two elastic legs and a short bar connecting said fork or said U-shaped clamp to a midpoint of an underside of said support plate in such a way that the longitudinal direction of the support plate extends transversally over an arm of the waiter, said support plate being adapted to carry a plate or a dish partly placed on a palm of the waiter, wherein the auxiliary device comprises a narrow gap located between said support plate and one of said elastic legs which is positioned at a side of said short bar that forms an acute angle with said support plate, and wherein said narrow gap is adapted to receive and fix an edge portion of a further plate.

2. Auxiliary device according to claim 1, wherein a bottom surface of the support plate defining said gap is provided with a friction means comprising a rubber pad provided with transverse folds or grooves.

3. Auxiliary device according to claim 1, wherein the auxiliary device is made of metal.

4. Auxiliary device according to claim 3, wherein the legs of the holder are made of spring steel.

5. Auxiliary device according to claim 1, wherein the auxiliary device is made of thermo resistant plastics or fibre-reinforced plastics.

6. Auxiliary device according to claim 1, wherein an upper surface of the support plate has a friction-increasing means.

7. Auxiliary device according to claim 6, wherein the friction increasing means is a polyurethane film or a rubber pad.

* * * * *